United States Patent [19]

Almering

[11] Patent Number: 4,881,012

[45] Date of Patent: Nov. 14, 1989

[54] SWITCHING ARRANGEMENT

[75] Inventor: Antonius F. J. Almering, Breda, Netherlands

[73] Assignee: U.S. Philips Corporation, New York, N.Y.

[21] Appl. No.: 128,667

[22] Filed: Dec. 4, 1987

[30] Foreign Application Priority Data

Dec. 15, 1986 [NL] Netherlands ..... 8603179

[51] Int. Cl.[4] ..... H05B 41/04

[52] U.S. Cl. ..... 315/209 R; 315/119; 315/127; 315/205; 315/209 T; 315/DIG. 7; 315/176

[58] Field of Search ..... 315/209 R, DIG. 7, DIG. 5, 315/205, 38, 207, 119, 120, 121, 122, 123, 125, 127, 209 T, 176; 307/326, 328, 110; 328/261; 363/62

[56] References Cited

U.S. PATENT DOCUMENTS 3,280,371 10/1966 Toda et al. ..... 315/290
3,723,849 3/1973 Ludloff ..... 363/62
3,900,786 8/1975 Jorda ..... 363/62
4,103,209 7/1978 Elms ..... 315/207
4,763,044 8/1988 Nuckolls et al. ..... 315/176

FOREIGN PATENT DOCUMENTS 1254892 11/1971 United Kingdom .

*Primary Examiner*—Donald J. Yusko
*Assistant Examiner*—Brian Palladino
*Attorney, Agent, or Firm*—Bernard Franzblau

[57] ABSTRACT

A switching arrangement for ignitio of a high-pressure discharge lamp. The switching arrangement is provided with means for suppressing the production of ignition pulses in case the lamp has ignited or in cast it fails. The switching arrangement comprises a pushpull circuit which is supplied on the one hand by the supply voltage and on the other hand by the voltage across the lamp. An output terminal of the push-pull circuit is connected to the means for suppressing the production of ignition pulses. Thus, it is achieved in a simple manner that the lamp voltage influences the blocking and activation of the production of ignition pulses.

17 Claims, 1 Drawing Sheet

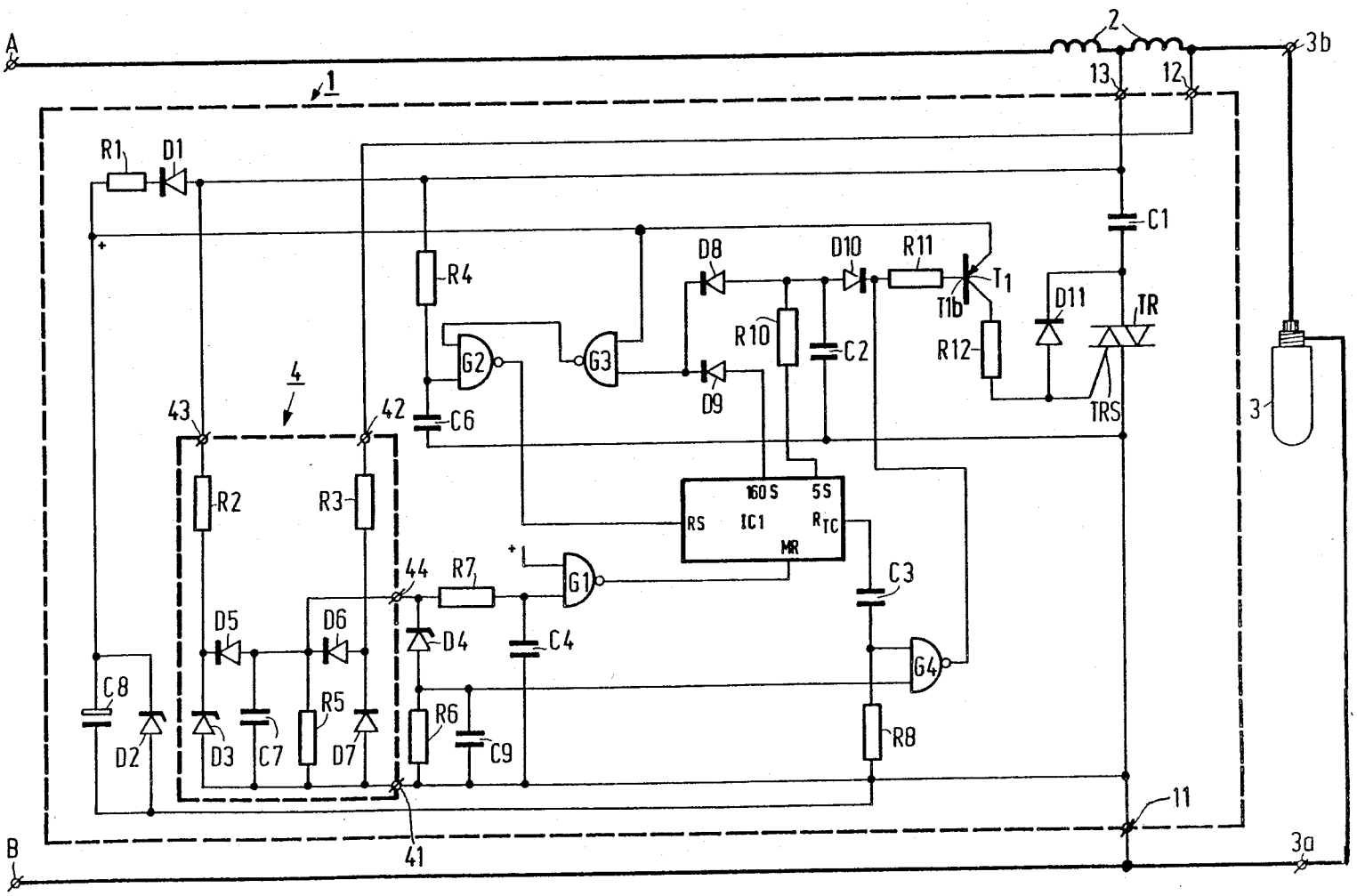
3b
3a
3
12
13
2
C1
TR
TRS
11
D11
T1
T1b
R12
R11
D10
C2
R10
D8
D9
G3
G2
C6
R4
G4
C3
R8
160S
5S
RTC
MR
IC1
RS
G1
C4
C9
R7
D4
R6
44
41
42
R3
D6
R5
D7
4
C7
R2
D5
D3
43
D1
R1
D2
C8
1
A
B

SWITCHING ARRANGEMENT

BACKGROUND OF THE INVENTION

This invention relates to a switching arrangement suitable for the ignition of at least one high-pressure discharge lamp by the production of ignition pulses. The switching arrangement is provided with at least three connection terminals, of which a first connection terminal is intended to be connected to a first terminal of the lamp and a second and a third connection terminal are suitable for connection on either side of an impedance connected in series with a second terminal of the lamp, and which is further provided with means for suppressing the production of ignition pulses if the lamp has ignited.

Such a switching arrangement is known under the type designation Philips SN 61 and is frequently used in practice, for example, in combination with a high-pressure sodium discharge lamp. The known starting arrangement is provided with an electronic circuit comprising a logic circuit, by means of which the production of pulses is blocked as soon as the voltage at an input of the logic circuit falls below an adjusted voltage level, which occurs as soon as the lamp ignites. In order to prevent the continued production of ignition pulses without interruption in the case of a defective lamp, the known switching arrangement is further provided with a counter circuit which blocks the production of ignition pulses after a preadjusted period of time. The production of ignition pulses is not activated until the supply voltage from which the switching arrangement is operated has been interrupted for some time.

The electronic circuit comprising the logic circuit, together with the counter circuit, forms part of the means for suppressing the production of ignition pulses if the lamp has ignited. A property of this known switching arrangement is that the production of ignition pulses remains blocked even if the lamp extinguishes without the supply voltage being interrupted. This means that when a lamp becomes defective during operation, the switching arrangement is not activated, which is a favourable aspect of the known switching arrangement.

In general a high-pressure lamp will already extinguish during operation when the applied supply voltage decreases in value for a short time without actually being interrupted. A decrease of 10% may already lead to extinguishing of the lamp. With the known switching arrangement, the lamp is not restarted under such conditions.

SUMMARY OF THE INVENTION

An object of the invention is to provide a means for obtaining in an efficacious and simple manner a switching arrangement which will be activated if the lamp extinguishes due to a transient decrease of the supply voltage, while maintaining the favourable aspect of the known switching arrangement. For this purpose, a switching arrangement of the kind mentioned in the opening paragraph is characterized in that a pushpull circuit is connected between the first, second and third connection terminals, of which an output terminal of the push-pull circuit is connected to the means for suppressing the production of ignition pulses. An advantage of the switching arrangement according to the invention is that the pushpull circuit makes it possible to compare the supply voltage with the voltage across the connected lamp so that the voltage across the lamp can influence the production of ignition pulses.

It is a known property of high-pressure discharge lamps, especially of high-pressure sodium discharge lamps, that during the life of the lamp the voltage across the lamp increases, as a result of which the lamp is more liable to extinguish upon a variation of the supply voltage. By means of the push-pull circuit the voltage across the lamp influences the activation and the blocking of the switching arrangement so that a distinction can be made between a lamp having a nominal lamp voltage and a lamp having an increased lamp voltage.

In an advantageous embodiment of a switching arrangement according to the invention, which is suitable to be supplied with alternating voltage, the pushpull circuit comprises a voltage division circuit coupled between the first and the third connection terminal, which is formed from the series circuit of a first resistor, a first diode and a capacitor, while the second connection terminal is connected through a series-combination of a second resistor and a second diode on the one hand to the capacitor and on the other hand to the series circuit of the first diode and the first resistor and with an anode of the first diode connected to a cathode of the second diode. By means of this configuration, it is achieved in a simple manner that during each period of the voltage across the lamp, the capacitor is subjected for a half cycle to a charge variation which is related to the voltage across the lamp, and is subjected during each period of the alternating voltage supply for a half cycle to a charge variation which is related to the supply voltage.

The polarities of the voltage across the lamp and of the supply voltage are opposite to each other during the charge variation. The charge on the capacitor averaged over a period, and therefore the voltage across the capacitor is thus proportional to the voltage across the lamp and is at least in part compensated for the influence of supply voltage variations.

Preferably, the switching arrangement according to the invention is adapted to be supplied with alternating voltage and the impedance in series with the connected lamp forms part of a stabilization ballast of the lamp. Since it is common practice to operate high-pressure discharge lamps with a alternating voltage, it is advantageous if the switching arrangement can also be operated with an alternating voltage. When also at least a part of the stabilization ballast of the lamp is utilized, the switching arrangement can be combined in a simple manner with the stabilization ballast to form a single arrangement. With a view to the cost of installation, this is advantageous.

BRIEF DESCRIPTION OF THE DRAWING

An embodiment of a switching arrangement according to the invention will be explained more fully with reference to the single FIGURE of the accompanying drawing.

DESCRIPTION OF THE PREFERRED EMBODIMENTS

In the drawing, A and B are the designated input terminals intended to be connected to an alternating voltage supply source for a lamp circuit provided with a switching arrangement 1 according to the invention. The terminal A is connected through a stabilization ballast 2 to a second terminal 3b of a discharge lamp 3.

A first terminal 3*a* of the lamp 3 is connected to the terminal B.

The switching arrangement is provided with three connection terminals 11,12,13. A first connection terminal 11 is connected to the first terminal 3*a* of the lamp 3. A third connection terminal 13 is connected to a centre tapping of the stabilization ballast 2 and a second connection terminal 12 is directly connected to the second terminal 3*b* of the lamp.

The third and first connection terminals 13,11 are interconnected through a series-combination of a capacitor $C_1$ and a triac TR, which serve to produce ignition pulses. The third connection terminal 13 is further connected through a series circuit comprising a diode $D_1$, a resistor $R_1$ and a capacitor $C_8$ shunted by a Zener diode $D_2$ to the connection terminal 11. The voltage across the capacitor $C_8$ serves as a direct voltage source for a transistor $T_1$, which is connected in series with a resistor $R_{12}$ to a control electrode TRS of the triac TR. The control electrode TRS is connected via a diode $D_{11}$ to a junction point between the capacitor $C_1$ and the triac TR.

The connection terminals 11,12,13 are interconnected through a pushpull circuit 4 provided with an output terminal 44 and with input terminals 41,42,43, which are connected to the connection terminals 11,12 and 13, respectively. The input terminals 41 and 43 are interconnected through a voltage division circuit constituted by a first resistor $R_2$, a first diode $D_5$ and a capacitor $C_7$. The connection terminal 42 is connected through a series-combination of a second resistor $R_3$ and a second diode $D_6$ on the one hand to the capacitor $C_7$ and on the other hand to the series circuit of the first diode $D_5$ and the first resistor $R_2$. An anode of the diode $D_5$ is connected to a cathode of the diode $D_6$. The capacitor $C_7$ is shunted by a resistor $R_5$ and is directly connected to the output terminal 44. The input terminal 41 is connected through a diode $D_7$ to the resistor $R_3$ and through a Zener diode $D_3$ to the resistor $R_2$. During a half cycle of the voltage across the lamp, the capacitor $C_7$ will be charged via the connection terminal 12, the input terminal 42, the resistor $R_3$ and the diode $D_6$ and will be partly discharged during a half cycle of the alternating voltage supply source via the diode $D_5$, the resistor $R_2$, the input terminal 43 and the connection terminal 13. Thus, a voltage is obtained at the output terminal 44, which voltage, averaged in time, is proportional to the voltage across the lamp 3 and is compensated at least in part for the influence of supply voltage variations.

The output terminal 44 is connected through a resistor $R_7$ to a first input of the NAND gate $G_1$. A capacitor $C_4$ connects the first input of the NAND gate $G_1$ to the connection terminal 11. The combination $R_7$–$C_4$ ensures that a direct voltage is applied to the first input of the NAND gate $G_1$ which voltage is proportional to the voltage across the capacitor $C_7$ and therefore depends upon the voltage across the lamp. A second input of the NAND gate $G_1$ is connected to a direct voltage source constituted by the voltage division circuit of the resistor $R_1$ and the capacitor $C_8$ (indicated in the drawing by +for the sake of simplicity). An output of the NAND gate $G_1$ is connected to a pin MR of an integrated counter circuit $IC_1$.

The output terminal 44 of the pushpull circuit 4 is also connected to a Zener diode $D_4$, which is connected on the one hand to a first input of a NAND gate $G_4$ and on the other hand via a parallel-combination of a resistor $R_6$ and a capacitor $C_9$ to the connection terminal 11. A second input of the NAND gate $G_4$ is connected via a resistor $R_8$ to the connection terminal 11 and via a capacitor $C_3$ to a pin $R_{TC}$ of $IC_1$.

A pin RS of $IC_1$ is connected to an output of a NAND gate $G_2$, of which a first input is connected via a voltage division circuit $C_6$,$R_4$ to the connection terminal 11 on the one hand and to the connection terminal 13 on the other hand. A second input of the NAND gate $G_2$ is connected to an output of a NAND gate $G_3$, of which a first input is connected to the junction point between $R_1$ and $C_8$ and of which a second input is connected on the one hand via a diode $D_9$ to the pin 160S of $IC_1$ and on the other hand via a diode $D_8$ and a resistor $R_{10}$ to the pin 5S of $IC_1$.

Further, the pin 5S is connected via the resistor $R_{10}$ to a junction point of a diode $D_{10}$ and a capacitor $C_2$. The capacitor $C_2$ is connected to the connection terminal 11 and the diode $D_{10}$ is connected to an output of the NAND gate $G_4$.

Immediately after the supply voltage source has been connected, the capacitor $C_4$ is still uncharged so that the output of the NAND gate $G_1$ conveys a high voltage for a short time, as a result of which the counters of $IC_1$ are set to zero via the pin MR of $IC_1$.

As long as the lamp is extinguished, the voltage between the connection terminals 11 and 12 and between 11 and 13, respectively, is substantially equal to the supply voltage. The capacitor $C_7$ of the pushpull circuit 4 and hence also the capacitors $C_9$ and $C_4$ are thus charged to a high voltage, as a result of which a comparatively high voltage is applied to the first input of the NAND gate $G_4$, as well as to the first input of the NAND gate $G_1$. Consequently, the output of the NAND gate $G_1$ has a low voltage and the counter circuit $IC_1$ is released and the counters of $IC_1$ start counting.

Short rectangular voltage pulses having a frequency equal to the frequency of the supply source are generated at the pin $R_{TC}$ of $IC_1$. By differentiation in the circuit $C_3$, $R_8$, needle pulses are thus obtained at the second input of $G_4$. These pulses are amplified via $G_4$ and the resistor $R_{11}$ by the transistor $T_1$ and are supplied to the control electrode TRS of the triac TR. The triac TR will become conductive at each pulse and will product ignition pulses in known manner via A, 2, $C_1$ and B.

The rectangular voltage pulses at the pin $R_{TC}$ are formed in $IC_1$ by means of pulses originating from the NAND gate $G_2$. The frequency of the pulses supplied by $G_2$ is derived from the supply source via the series circuit $R_4$,$C_6$. The pin 160S is a counter output which between 0 and 160S has a low voltage and has a high voltage from 160S. Sue to the high voltage at the pin 160S, the output of the NAND gate G3 becomes low and hence the NAND gate $G_2$ is blocked so that the production of ignition pulses is also blocked. The pin 5S of $IC_1$ is a counter output which supplies rectangular voltage pulses having a pulse width of 5 s and a repetition frequency of 0.1 Hz. Due to the fact that on the one hand the pin 5S is connected to the output terminal 11 via the resistor $R_{10}$ and the capacitor $C_2$ and on the other hand the capacitor $C_2$ is connected to the output of the NAND gate $G_4$ via the diode $D_{10}$, it is ensured that the capacitor $C_2$ is not charged via the voltage originating from the pin 5S as long as pulses are supplied by the NAND gate $G_4$.

As soon as the lamp ignites, the voltage between the connection terminals 11 and 12 will decrease, as a result of which the voltage across $C_7$ decreases, just like the voltage at the first input of the NAND gate $G_4$. The voltage at the output of the NAND gate $G_4$ then becomes high, as a result of which the transistor $T_1$ is cut off so that the production of ignition pulses is suppressed. At the same time, a high voltage is also applied to the output of the NAND gate $G_1$, as a result of which the counters of $IC_1$ are set to zero.

If, due to a transient decrease of the supply voltage, the lamp extinguishes, the voltage at the connection terminal 12 will become substantially equal to that at the connection terminal 13. As a result, the voltage across $C_7$ increases and $G_4$ is opened again, just like $G_1$ and hence the counter circuit IC1. As a result, the production of ignition pulses is activated again.

In case the lamp voltage is comparatively high, the average voltage across the capacitor $C_7$ becomes so high that, although a low voltage is applied to the output of the NAND gate $G_1$, the voltage at the input of $G_4$ remains low because the threshold of the Zener diode $D_4$ is then not reached. Due to the low voltage at the output of the NAND gate $G_1$, the pin 5S of $IC_1$ will have a low voltage for 5 seconds. After 5 s, the voltage of the pin 5S becomes high. Since the voltage at the output of the NAND gate $G_4$ has remained high, the capacitor $C_2$ will be charged and the counter circuit $IC_1$ is stopped via the NAND gates $G_3$ and $G_2$. Since the voltage at the input of the NAND gate $G_1$ remains high, the voltage at the output of the NAND gate $G_1$ remains low and the counters are not set to zero.

If the lamp is still extinguished, this will not change the state of the NAND gate $G_1$ so that $IC_1$ remains blocked. Thus, the possibility of production of ignition pulses remains blocked.

The NAND gates $G_1$, $G_2$, $G_3$, $G_4$, just like the integrated circuit $IC_1$, are supplied with the voltage across the capacitor $C_8$. For the sake of clarity, this is not shown in the drawing.

In order to clearly define the voltage at the second input of NAND gate $G_3$ in case both diodes $D_8$ and $D_9$ are non-conducting, it can be advantageous to connect the second input of $G_3$ via a resistor to terminal 11.

In a practical embodiment, the switching arrangement is connected to a supply voltage of 220 V, 50 Hz. The most important components of the arrangement are then proportioned as follows:

| | |
|---|---|
| G1, G2, G3, G4 | = HEF 4093 BP |
| IC1 | = HEF 4060 BP |
| C7 | 470 nF |
| R2 | 1,5 MΩ |
| R3 | 1 MΩ |
| R5 | 1,5 MΩ |
| T1 | BC 557 C |
| TR | BT 138/800 |
| D3 | BZX 79 C20 |
| D4 | BZX 79 7.5 V |
| D5, D6, D7 | BAW 62 |

By means of the switching arrangement described, a large number of high-pressure sodium discharge lamps is operated at a supply voltage of 220 V, 50 Hz. The nominal power of the operated lamps varied from 150 W to 1000 W. The threshold value of the lamp voltage at which, after the lamp has extinguished due to a decrease of the supply voltage, the production of ignition pulses remains blocked, lies at 130 V. By variation of the value of the resistor $R_2$, this threshold value can be adjusted to a different value.

What is claimed is:

1. A switching arrangement for ignition of at least one high-pressure discharge lamp by the production of ignition pulses comprising, a first connection terminal intended to be connected to a first terminal of the lamp and a second and a third connection terminal for connection on either side of an impedance connected in series with a second terminal of the lamp, and means for suppressing the production of ignition pulses if the lamp fails, characterized in that a pushpull circuit is connected between the first, second and third connection terminals and is responsive to a voltage between said first and second terminals to produce at an output terminal thereof a control signal for said ignition pulse suppressing means, and means connecting the output terminal of the pushpull circuit to the means for suppressing the production of ignition pulses.

2. A switching arrangement as claimed in claim 1, characterized in that the switching arrangement is adapted to be supplied with alternating voltage and the pushpull circuit comprises a voltage division circuit coupled between the first and the third connection terminal and formed from a series circuit including a first resistor, a first diode and a capacitor, and in that the second connection terminal is connected through a series-combination of a second resistor and a second diode to the capacitor and to the series circuit of the first diode and the first resistor, an anode of the first diode being connected to a cathode of the second diode.

3. A switching arrangement as claimed in claim 2, wherein the impedance in series with a connected lamp forms a part of a stabilization ballast of the lamp.

4. A switching arrangement as claimed in claim 1, wherein the switching arrangement is adapted to be supplied with alternating voltage and the impedance in series with a connected lamp forms a part of a stabilization ballast for the lamp.

5. An apparatus for ignition and operation of a high-pressure discharge lamp comprising:

means for connecting an impedance device in series with the lamp across a pair of AC supply voltage input terminals, means for producing ignition pulses for the lamp coupled to first and second output terminals for connection to a lamp, a circuit for controlling the operation of said ignition pulse producing means, a push-pull circuit for generating an ignition control signal at an output thereof, said push-pull circuit having first, second and third input terminals coupled to said first output terminal, said second output terminal and to said impedance device, respectively, and an electric storage device coupled to said second and third input terminals and said output whereby the storage device is responsive to the supply voltage and to the lamp voltage at different times in a cycle of the AC supply voltage thereby to produce an ignition control signal at said output of the push-pull circuit that is determined by the lamp voltage and in part by the supply voltage, and means coupling said ignition control signal to said controlling circuit whereby the controlling circuit is operative to suppress the production of ignition pulses in the case of lamp failure or upon ignition of the lamp.

6. An apparatus as claimed in claim 5 wherein the storage device comprises a capacitor, and further comprising, a first diode coupling said capacitor to said third input terminal to provide a discharge path for the capacitor, and a second diode coupling said capacitor to the second input terminal to provide a charge path for the capacitor.

7. An apparatus as claimed in claim 6 wherein said first and second diodes have a common junction point that is coupled to said capacitor and to said output of the push-pull circuit, and wherein an anode of one diode and a cathode of the other diode are connected to said common junction point.

8. An apparatus as claimed in claim 5 wherein the storage device comprises a capacitor, and further comprising, first and second diodes coupling said capacitor to said third and second input terminals, respectively, such that the capacitor is subjected to a charge variation related to the lamp voltage during a half cycle of the lamp voltage and is subjected to a charge variation related to the supply voltage during a half cycle of the AC supply voltage, the lamp voltage and the supply voltage being of opposite polarity during the charge variation.

9. An apparatus as claimed in claim 5 wherein the storage device comprises a capacitor, and further comprising, a first resistor and a first diode connected in series circuit, in the order named, between the third input terminal and a terminal of the capacitor, and a second resistor and a second diode connected in a second series circuit, in the order named, between the second input terminal and said capacitor terminal, said first and second diodes being connected with opposite polarity as seen from said capacitor terminal.

10. Apparatus as claimed in claim 5 wherein said ignition pulse producing means comprise a capacitor and a controlled semiconductor switching device connected in series circuit between said first output terminal and said third input terminal of the push-pull circuit.

11. Apparatus as claimed in claim 5 wherein said impedance device comprises an inductor that is a part of the ballast impedance for the lamp, one terminal of the inductor being connected to said second output terminal, a second terminal thereof being coupled to one of said supply voltage input terminals, and a tap point of the inductor being connected to said third input terminal of the push-pull circuit, and wherein said ignition pulse producing means comprise a capacitor and a controlled semiconductor switching device connected in series circuit between said first output terminal and said tap point of the inductor.

12. A switching arrangement for producing ignition pulses for a high-pressure discharge lamp comprising:

first, second and third connection terminals for connection to one terminal of a lamp, to a first terminal of an impedance device adapted to be connected in series with the lamp and to a second terminal of said impedance device, respectively, means for producing ignition pulses coupled to said third connection terminal, a control circuit for controlling operation of said ignition pulse producing means, a push-pull circuit having first, second and third input terminals coupled to said first, second and third connection terminals, respectively, an electric storage device coupled to said second and third input terminals whereby the storage device is responsive to the supply voltage and to the lamp voltage thereby to produce an ignition control signal at an output of the push-pull circuit that is determined by the lamp voltage and in part by the supply voltage, and wherein the control circuit is responsive to said ignition control signal so as to suppress the production of ignition pulses in the case of lamp failure or upon ignition of the lamp.

13. A switching arrangement as claimed in claim 12 wherein the storage device comprises a capacitor, and said push-pull circuit further comprises, a first diode coupling said capacitor to said third input terminal to provide a discharge path for the capacitor, and a second diode coupling said capacitor to the second input terminal to provide a charge path for the capacitor.

14. A switching arrangement for controlling the ignition of a high-pressure discharge lamp connected in series circuit with an impedance device across a pair of AC supply voltage input terminals, said switching arrangement comprising:

first, second and third connection terminals for connecting the switching arrangement to a first terminal of the lamp and first and second terminals of the impedance device, respectively, said second terminal of the impedance device being connected to a second terminal of the lamp, means adapted to be coupled to the lamp terminals for generating lamp ignition pulses, a push-pull circuit connected between said first, second and third connection terminals and responsive to first and second voltages developed between said first and second terminals and between said first and third terminals, respectively, to produce an ignition control signal at an output of the push-pull circuit, and means coupling said output of the push-pull circuit to a control input of the ignition pulse generating means to control the operation thereof as a function of said first and second voltages.

15. A switching arrangement as claimed in claim 14 wherein said first and second voltages are dependent on lamp voltage and on the A/C supply voltage, respectively, whereby the ignition control signal is determined by the lamp voltage and by the A/C supply voltage.

16. A switching arrangement as claimed in claim 14 wherein said push-pull circuit further comprises a capacitor coupled to said second and third connection terminals via first and second diodes, respectively, oppositely polarized as seen from a common capacitor terminal.

17. A switching arrangement as claimed in claim 16 wherein the push-pull circuit further comprises first and second resistors connected in series with said first and second diodes, respectively, so as to provide an RC charge path and an RC discharge path for the capacitor whereby the net capacitor voltage is determined by said first and second voltages and the RC time constants of the charge and discharge paths.

* * * * *